US010301059B1

(12) United States Patent
Lachinian et al.

(10) Patent No.: US 10,301,059 B1
(45) Date of Patent: May 28, 2019

(54) CONFIGURABLE STORAGE CONTAINER AND ASSOCIATED USE THEREOF

(71) Applicants: Grisha Lachinian, Murrieta, CA (US); Isabel Lachin, Murrieta, CA (US)

(72) Inventors: Grisha Lachinian, Murrieta, CA (US); Isabel Lachin, Murrieta, CA (US)

( * ) Notice: Subject to any disclaimer, the term of this patent is extended or adjusted under 35 U.S.C. 154(b) by 58 days.

(21) Appl. No.: 15/461,318

(22) Filed: Mar. 16, 2017

Related U.S. Application Data

(60) Provisional application No. 62/308,946, filed on Mar. 16, 2016.

(51) Int. Cl.

| | |
|---|---|
| ***B65D 5/00*** | (2006.01) |
| ***B65D 43/02*** | (2006.01) |
| ***B65D 43/16*** | (2006.01) |
| ***B65D 47/00*** | (2006.01) |
| ***B65D 81/32*** | (2006.01) |
| *B65D 85/80* | (2006.01) |

(52) U.S. Cl.
CPC ..... *B65D 5/009* (2013.01); *B65D 5/008* (2013.01); *B65D 43/02* (2013.01); *B65D 43/16* (2013.01); *B65D 47/00* (2013.01); *B65D 81/3205* (2013.01); *B65D 85/80* (2013.01)

(58) Field of Classification Search
CPC ..... B65D 5/009; B65D 5/0083; B65D 5/008; B65D 81/3205; B65D 2501/24191; B65D 51/005; B65D 51/20
See application file for complete search history.

(56) References Cited

U.S. PATENT DOCUMENTS

| | | | | |
|---|---|---|---|---|
| 1,095,671 A * | 5/1914 | Pitken | B65D 5/008 229/100 |
| 2,151,066 A * | 3/1939 | Anderson | G09B 23/04 229/116 |
| 2008/0283484 A1* | 11/2008 | Michalsky | B65D 3/268 215/235 |
| 2017/0183122 A1* | 6/2017 | Knutsen | B65D 21/0206 |

* cited by examiner

*Primary Examiner* — Fenn C Mathew
*Assistant Examiner* — Jennifer Castriotta
(74) *Attorney, Agent, or Firm* — Ashkan Najafi

(57) ABSTRACT

A portable storage container includes a plurality of connected pyramid-shaped bodies having a plurality of coextensively shaped pyramid-shaped receptacles, respectively. The pyramid-shaped bodies are configured to be folded into a cube having a plurality of sides each associated with a corresponding one of the pyramid-shaped bodies. In this manner, each of the pyramid-shaped bodies is contiguously situated and abutted against adjacent ones of the pyramid-shaped bodies. Notably, each of the pyramid-shaped receptacles is isolated from adjacent ones of the pyramid-shaped receptacles. At least one fastener is coupled to a first one of the pyramid-shaped bodies and detachably mated to a second one of the pyramid-shaped bodies.

17 Claims, 14 Drawing Sheets

CONFIGURABLE STORAGE CONTAINER AND ASSOCIATED USE THEREOF

CROSS REFERENCE TO RELATED APPLICATIONS

This is a non-provisional patent application that claims the benefit of U.S. provisional patent application No. 62/308,946 filed Mar. 16, 2016, which is incorporated by reference herein in its entirety.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to storage containers and, more particularly, to a portable storage container configured as six (6) separate pyramid-shaped receptacles, forming a single cube for packaging beverages and a plethora of other liquid, powder, and solid household items within one cleverly packaged unit.

Prior Art

In few areas do Americans' taste vary as widely as in beverages. Once they have reached the point where milk is not the only game in town, choices provide an almost unending assortment of drinks, with each category containing a plethora of selections. From frothy cappuccinos and herbal teas to citrus-tinged colas and fruity combination juices featuring apple and *papaya*, there is sure to be a tasty beverage for anyone. In addition to providing a refreshing drink to accentuate a meal or a needed boost of energy in the mornings, beverages also serve a practical and healthy purpose in that they rehydrate the body with much needed liquids. Whether beverages are purchased for health reasons or simple enjoyment, refrigerators across America are filled to bursting with a wide variety of containers to satisfy the needs and preferences of the entire family. Orange juice, fruit punch, and chocolate milk for the kids, and skim milk, grapefruit juice, and sports drinks for adults all wrestle for space within the crowded confines of the kitchen cooler. Not only does purchasing everyone's drink of choice tend to take away valuable refrigerator space, but this practice also can be quite expensive in the long run.

Accordingly, a need remains for configurable storage container in order to overcome at least one aforementioned shortcoming. The exemplary embodiment(s) satisfy such a need by providing a portable storage container configured as six (6) separate pyramid-shaped receptacles, forming a single cube that is convenient and easy to use, lightweight yet durable in design, versatile in its applications, and designed for packaging beverages and a plethora of other liquid, powder, and solid household items within one cleverly packaged unit.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a portable storage container for packaging and transporting liquids, powder, and solid items. These and other objects, features, and advantages of the non-limiting exemplary embodiment(s) are provided by the portable storage container includes a plurality of connected pyramid-shaped bodies having a plurality of coextensively shaped pyramid-shaped receptacles, respectively. Advantageously, the pyramid-shaped bodies are configured to be folded into a cube having a plurality of sides each associated with a corresponding one of the pyramid-shaped bodies. In this manner, each of the pyramid-shaped bodies is contiguously situated and abutted against adjacent ones of the pyramid-shaped bodies. Notably, each of the pyramid-shaped receptacles is isolated from adjacent ones of the pyramid-shaped receptacles. At least one fastener is coupled to a first one of the pyramid-shaped bodies and detachably mated to a second one of the pyramid-shaped bodies.

In a non-limiting exemplary embodiment, the pyramid-shaped bodies include a first pyramid-shaped body having a plurality of interconnected first walls configured to form a first pyramid shape wherein a first one of the pyramid-shaped receptacles is disposed within an interior perimeter of the interconnected first walls, a second pyramid-shaped body having a plurality of interconnected second walls configured to form a second pyramid shape wherein a second one of the pyramid-shaped receptacles is disposed within an interior perimeter of the interconnected second walls, a third pyramid-shaped body having a plurality of interconnected third walls configured to form a third pyramid shape wherein a third one of the pyramid-shaped receptacles is disposed within an interior perimeter of the interconnected third walls, a fourth pyramid-shaped body having a plurality of interconnected fourth walls configured to form a fourth pyramid shape wherein a fourth one of the pyramid-shaped receptacles is disposed within an interior perimeter of the interconnected fourth walls, a fifth pyramid-shaped body having a plurality of interconnected fifth walls configured to form a fifth pyramid shape wherein a fifth one of the pyramid-shaped receptacles is disposed within an interior perimeter of the interconnected fifth walls, and a sixth pyramid-shaped body having a plurality of interconnected sixth walls configured to form a sixth pyramid shape wherein a sixth one of the pyramid-shaped receptacles is disposed within an interior perimeter of the interconnected sixth walls.

In a non-limiting exemplary embodiment, the first pyramid-shaped body has a first apex centrally located inside the cube. Similarly, the second pyramid-shaped body has a second apex centrally located inside the cube. Similarly, the third pyramid-shaped body has a third apex centrally located inside the cube. Similarly, the fourth pyramid-shaped body has a fourth apex centrally located inside the cube. Similarly, the fifth pyramid-shaped body has a fifth apex centrally located inside the cube. Similarly, the sixth pyramid-shaped body has a sixth apex centrally located inside the cube.

In a non-limiting exemplary embodiment, each of the first apex, the second apex, the third apex, the fourth apex, the fifth apex, and the sixth apex are directly engaged with each other at a center of the cube.

In a non-limiting exemplary embodiment, the first pyramid-shaped body includes a first open side opposed from the first apex and situated at a first side of the plurality of sides of the cube. Similarly, the second pyramid-shaped body includes a second open side opposed from the second apex and situated at a second side of the plurality of sides of the cube. Similarly, the third pyramid-shaped body includes a third open side opposed from the third apex and situated at a third side of the plurality of sides of the cube. Similarly, the fourth pyramid-shaped body includes a fourth open side opposed from the fourth apex and situated at a fourth side of the plurality of sides of the cube. Similarly, the fifth pyramid-shaped body includes a fifth open side opposed from the fifth apex and situated at a fifth side of the plurality of sides of the cube. Similarly, the sixth pyramid-shaped body includes a sixth open side opposed from the sixth apex and situated at a sixth side of the plurality of sixth of the cube.

In a non-limiting exemplary embodiment, the first pyramid-shaped receptacle begins from the first open side and terminates at the first apex. Similarly, the second pyramid-shaped receptacle begins from the second open side and terminates at the second apex. Similarly, the third pyramid-shaped receptacle begins from the third open side and terminates at the third apex. Similarly, the fourth pyramid-shaped receptacle begins from the fourth open side and terminates at the fourth apex. Similarly, the fifth pyramid-shaped receptacle begins from the fifth open side and terminates at the fifth apex. Similarly, the sixth pyramid-shaped receptacle begins from the sixth open side and terminates at the sixth apex.

In a non-limiting exemplary embodiment, a plurality of caps are removably attached to corresponding ones of the first open side, the second open side, the third open side, the fourth open side, the fifth open side, and the sixth open side. Notably, at least one of the caps includes a bottom section removably attached to the cube and has a first aperture in fluid communication with a corresponding one of the pyramid-shaped receptacles. A top section is attached to the bottom section.

In a non-limiting exemplary embodiment, the top section has a continuous and uninterrupted outer surface wherein the top section is detachable from the bottom section. Notably, the bottom section further has a pull tab affixed thereto.

In a non-limiting exemplary embodiment, the top section is pivotally attached to the bottom section wherein the top section has a second aperture in fluid communication with the first aperture.

The present disclosure further includes a method of utilizing a portable storage container for packaging and transporting liquids, powder, and solid items. Such a method includes the steps of: providing a plurality of coextensively shaped and connected pyramid-shaped bodies having a plurality of pyramid-shaped receptacles, respectively; folding the pyramid-shaped bodies into a cube having a plurality of sides each associated with a corresponding one of the pyramid-shaped bodies such that each the pyramid-shaped bodies is contiguously situated and abutted against adjacent ones of the pyramid-shaped bodies; isolating each the pyramid-shaped receptacles from adjacent ones of the pyramid-shaped receptacles; coupling at least one fastener to a first one of the pyramid-shaped bodies; and detachably mating the at least one fastener to a second one of the pyramid-shaped bodies.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
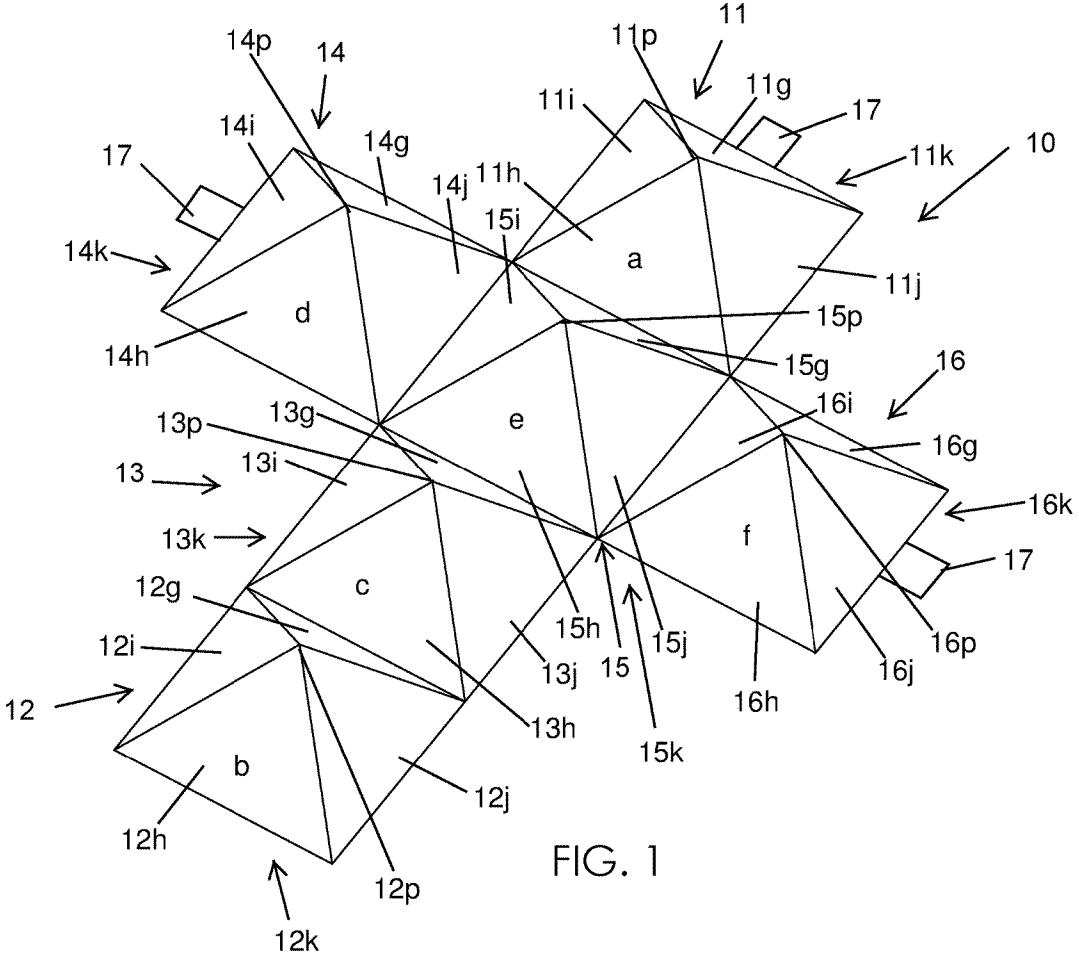
FIG. 1 is a perspective view illustrating a configurable storage container at an unfolded state, in accordance with a non-limiting exemplary embodiment.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about" means approximately or nearly and in the context of a numerical value or range set forth means±15% of the numerical.

If used herein, "substantially" means largely if not wholly that which is specified but so close that the difference is insignificant.

Figure 2:
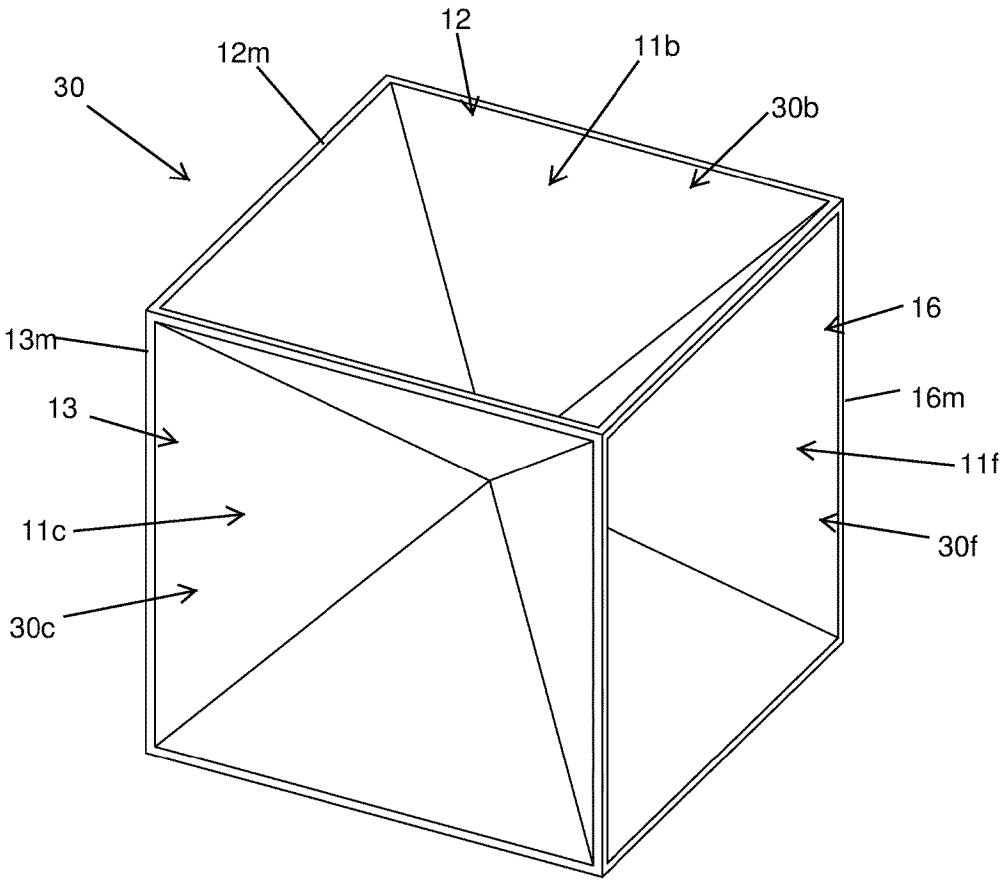
FIG. 2 is a perspective view illustrating the configurable storage container of FIG. 1, at a folded state.
Figure 3:
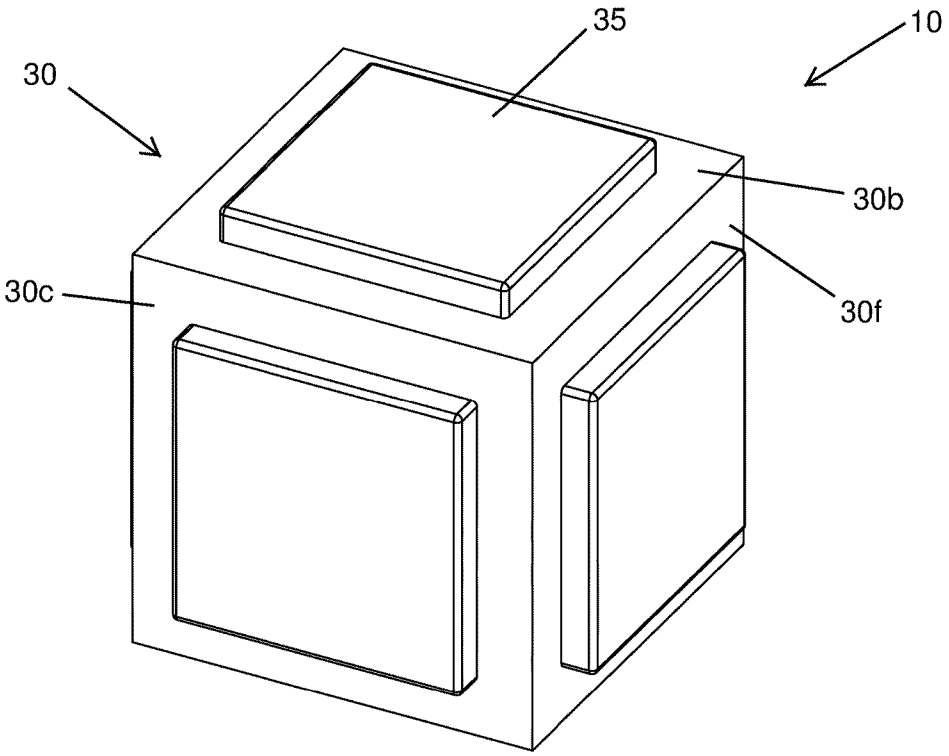
FIG. 3 is a perspective view illustrating the folded storage container of FIG. 2 with caps positioned over each pyramid-shaped receptacle, in accordance with a non-limiting exemplary embodiment.
Figure 4:
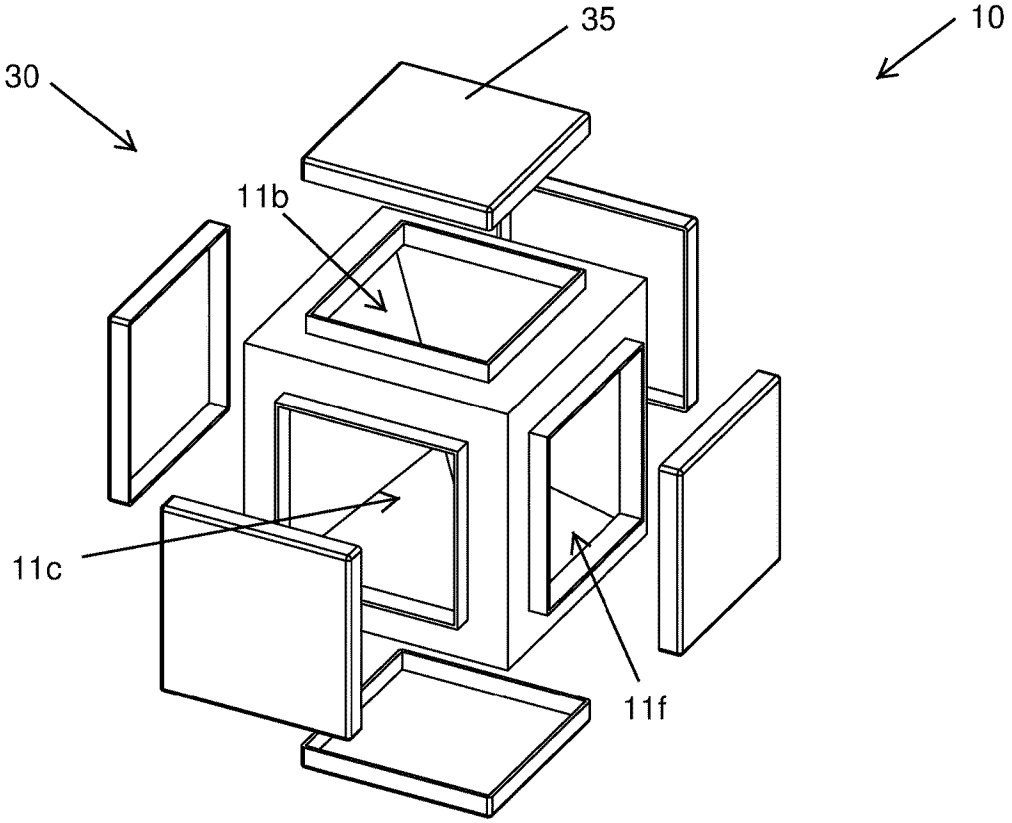
FIG. 4 is an exploded view of the folded storage container shown in FIG. 3.
Figure 6:
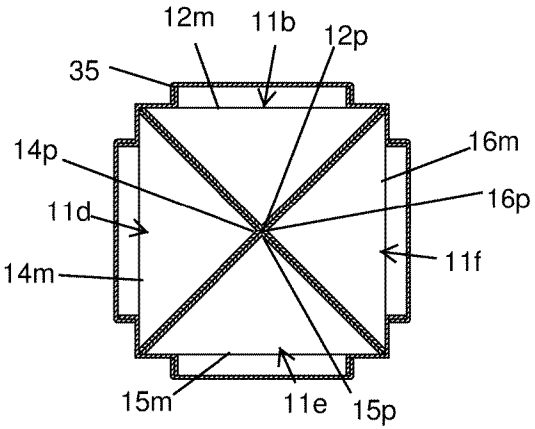
FIG. 6 is a cross-sectional view taken along line 6-6 in FIG. 5.
Figure 8:
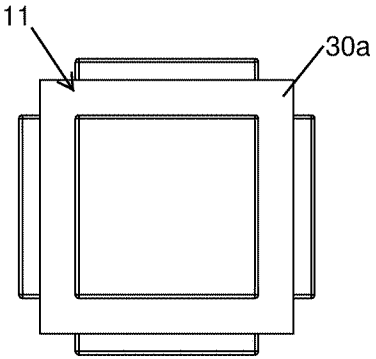
FIG. 8 is a rear elevational view of the folded storage container shown in FIG. 3.
Figure 5:
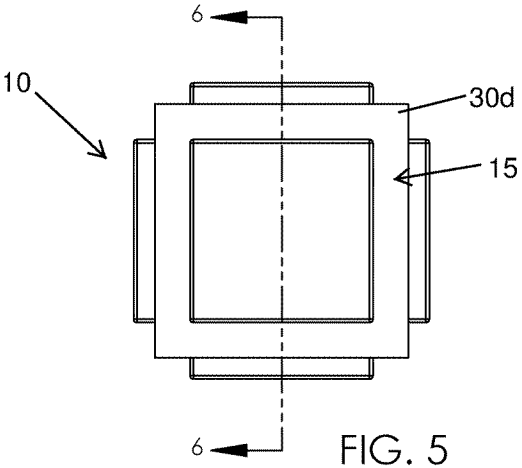
FIG. 5 is a side elevational view of the folded storage container shown in FIG. 3.
Figure 7:
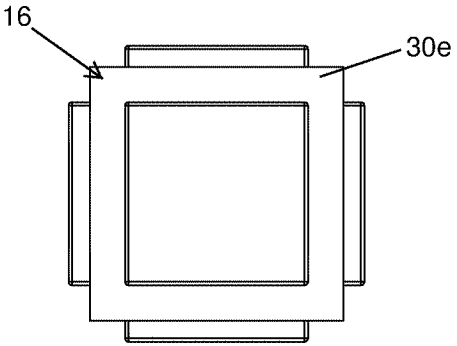
FIG. 7 is a bottom plan view of the folded storage container shown in FIG. 3.
Figure 9:
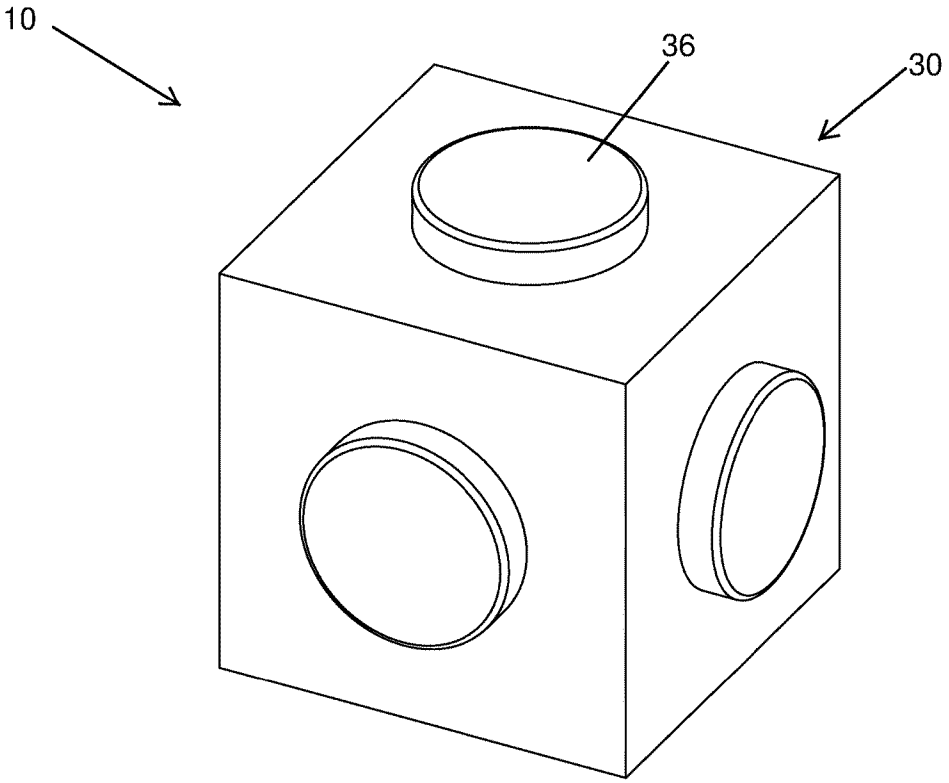
FIG. 9 is a perspective view of a folded storage container employing alternate caps, in accordance with a non-limiting exemplary embodiment.
Figure 10:
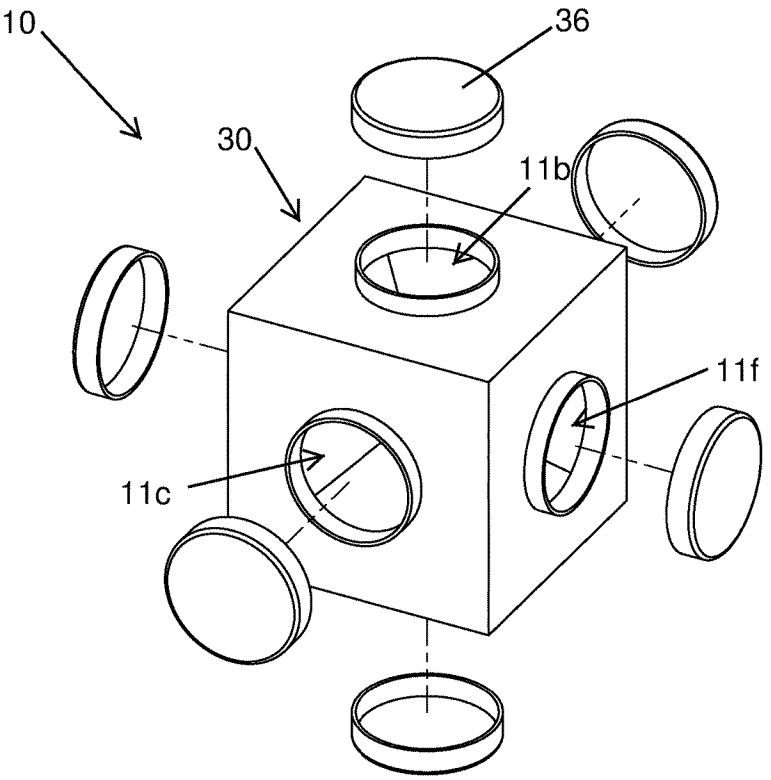
FIG. 10 is an exploded view of the folded storage container shown in FIG. 9.
Figure 11:
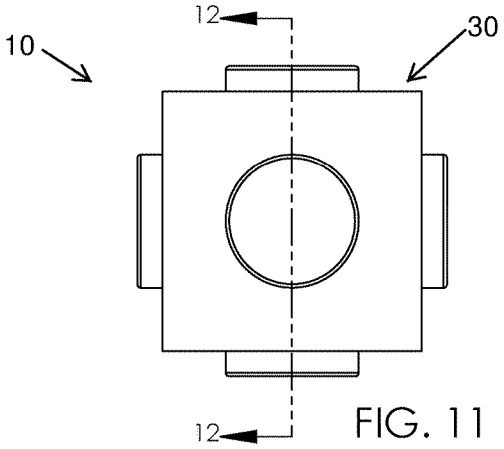
FIG. 11 is a side elevational view of the folded storage container shown in FIG. 9.
Figure 12:
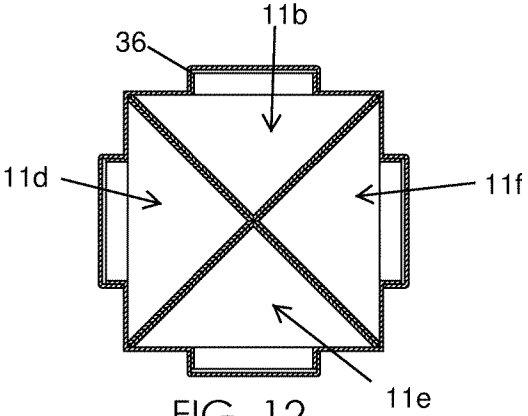
FIG. 12 is a cross-sectional view taken along line 12-12 in FIG. 11.
Figure 13:
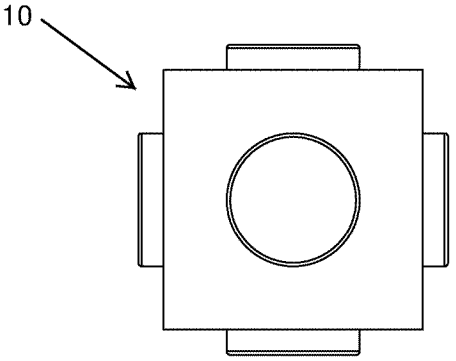
FIG. 13 is a bottom plan view of the folded storage container shown in FIG. 9.
Figure 14:
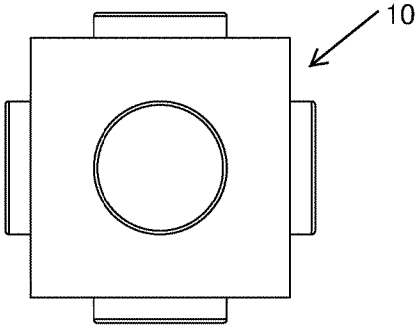
FIG. 14 is a rear elevational view of the folded storage container shown in FIG. 9.
Figure 15:
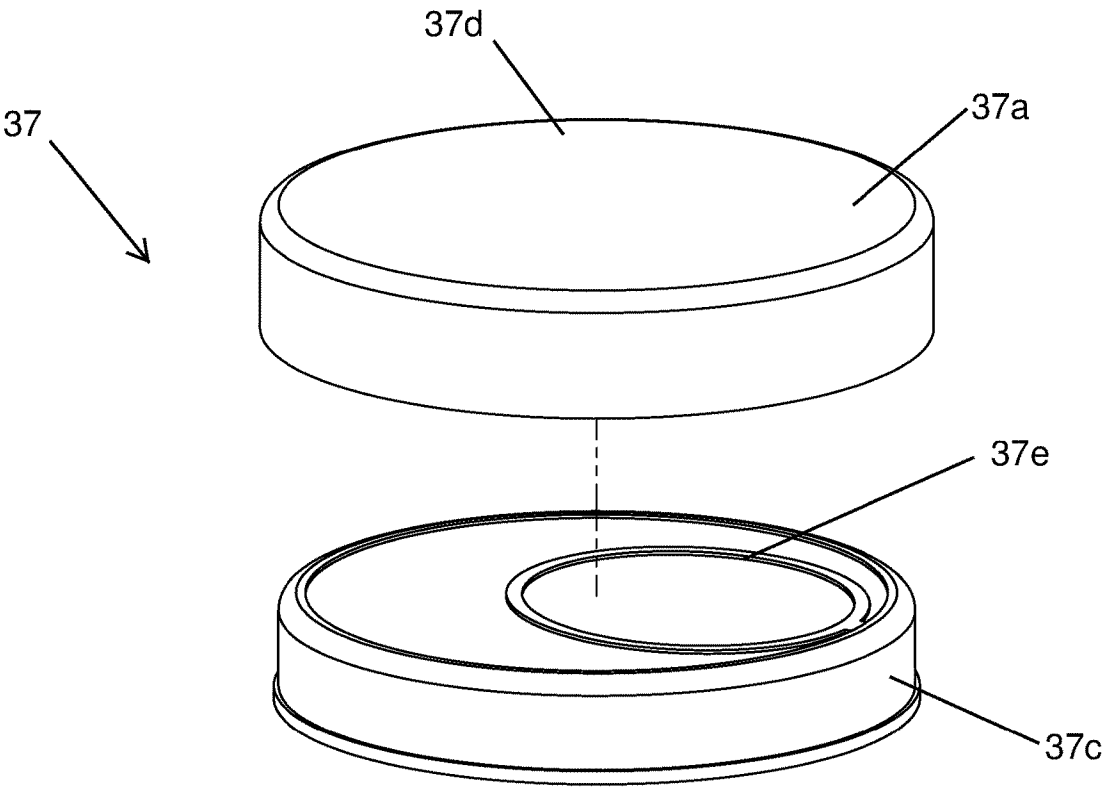
FIG. 15 is a perspective view of a cap, in accordance with a non-limiting exemplary embodiment.
Figure 16:
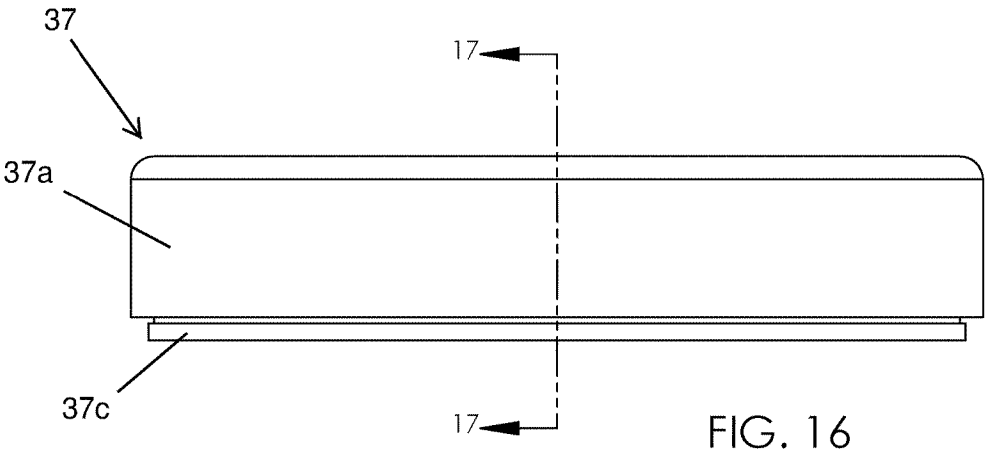
FIG. 16 is a side elevational view of the cap shown in FIG. 15.
Figure 17:
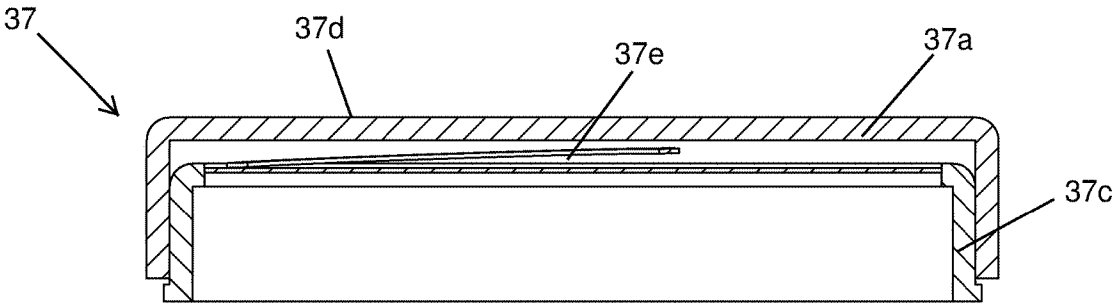
FIG. 17 is a cross-sectional view taken along line 17-17 in FIG. 16.
Figure 18:
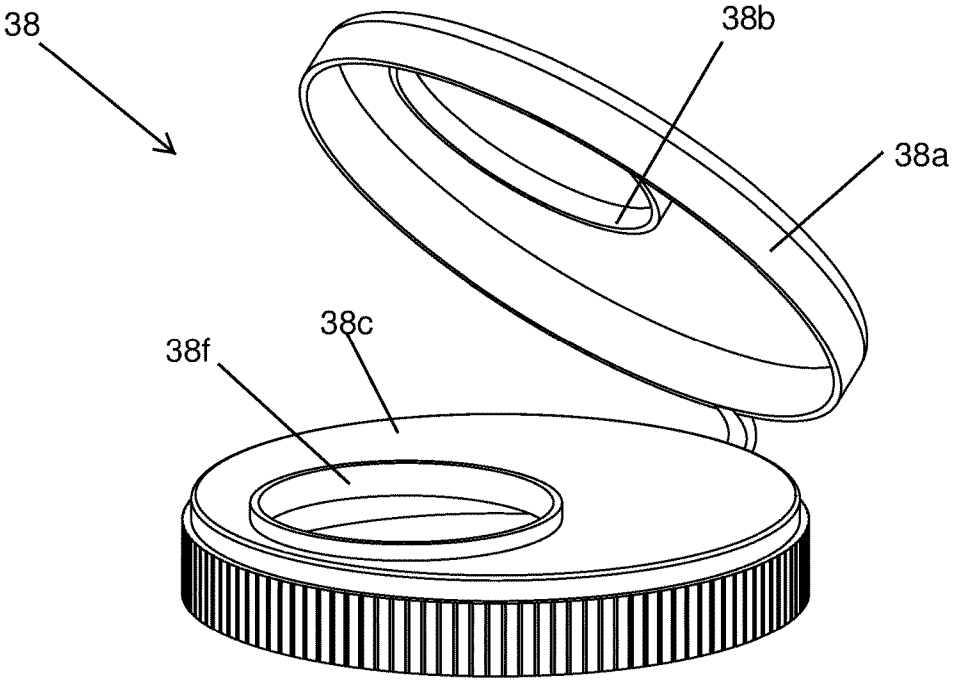
FIG. 18 is a perspective of a cap, in accordance with yet another non-limiting exemplary embodiment.
Figure 20:
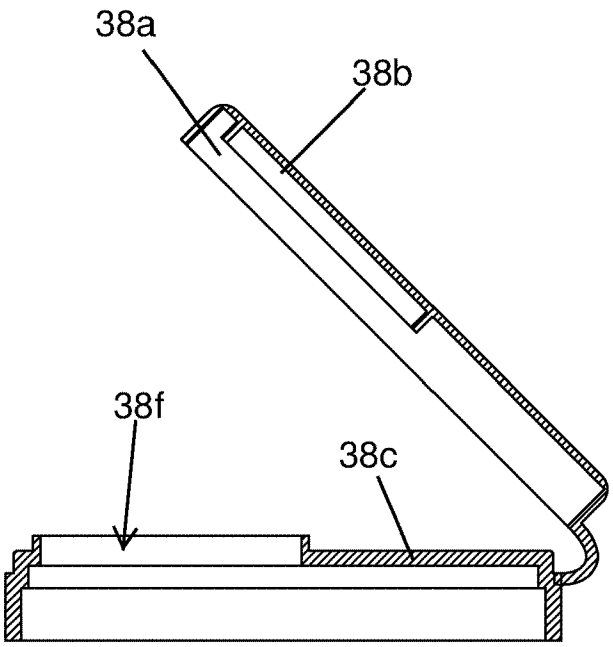
FIG. 20 is a cross-sectional view taken along line 20-20 in FIG. 19.
Figure 19:
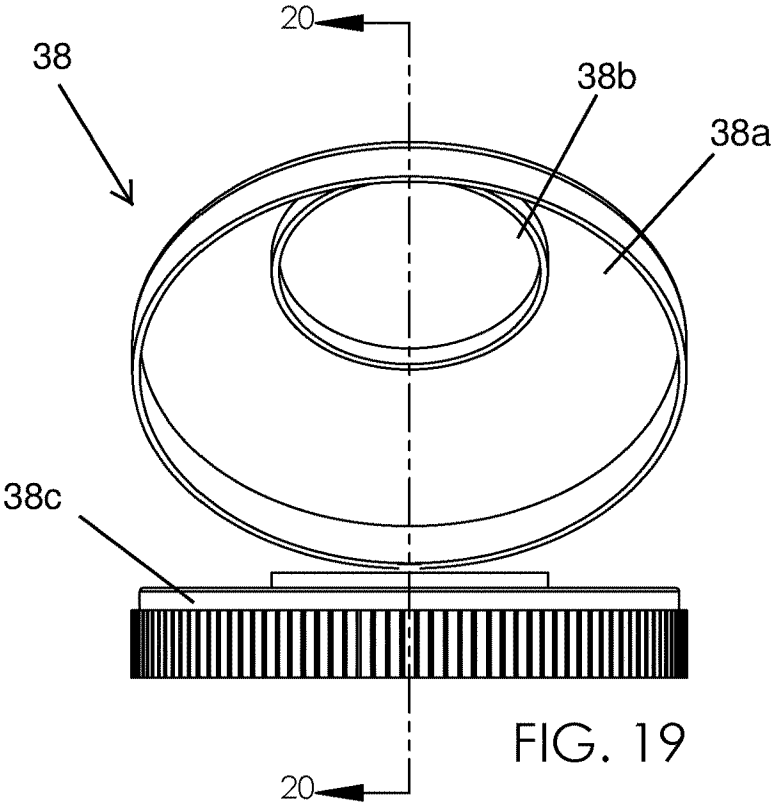
FIG. 19 is a front elevational view of the cap shown in FIG. 18.
Figure 21:
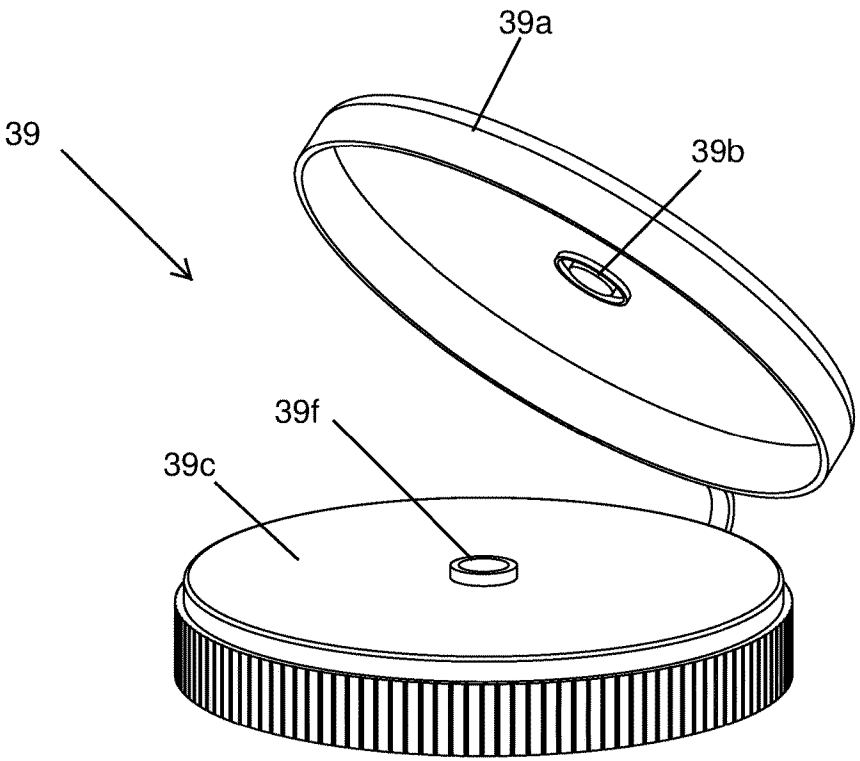
FIG. 21 is a perspective view of a cap, in accordance with yet another non-limiting exemplary embodiment.
Figure 23:
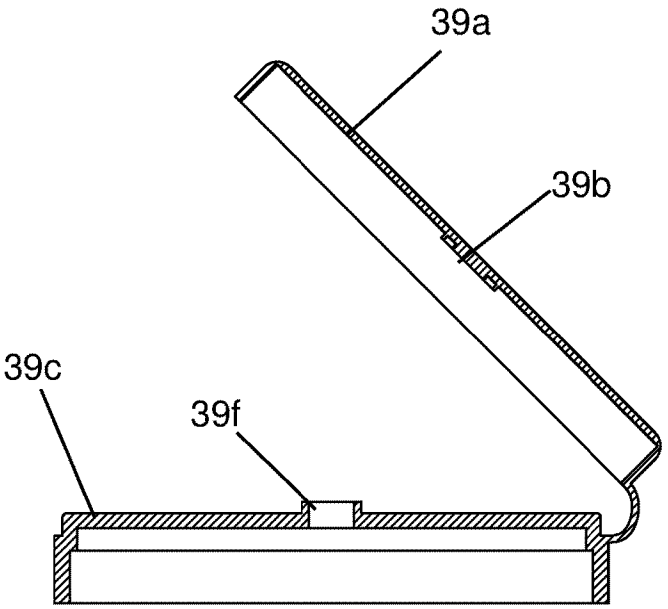
FIG. 23 is a cross-sectional view taken along line 23-23 in FIG. 22.
Figure 22:
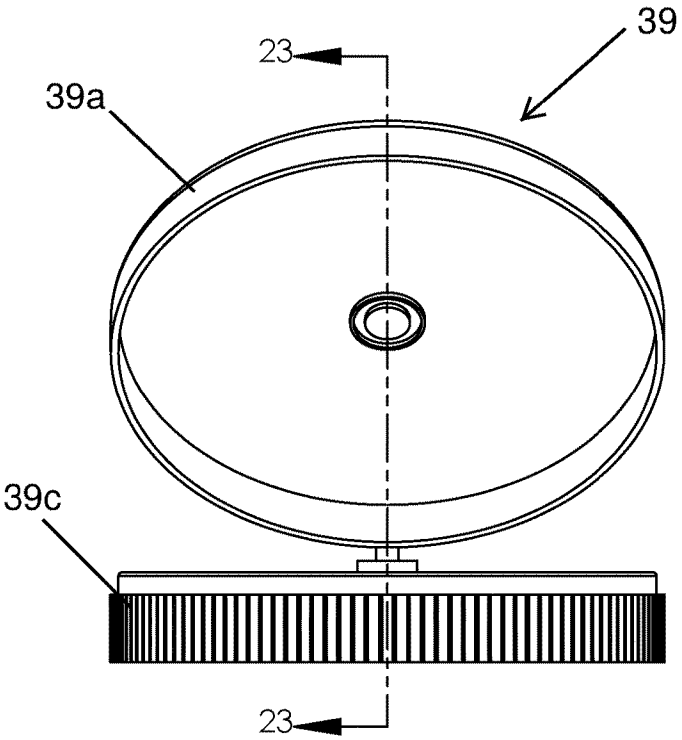
FIG. 22 is a front elevational view of the cap shown in FIG. 21.

Non-limiting exemplary embodiment(s) of the present disclosure is referred to generally in FIGS. 1-23 and are intended to provide a portable storage container 10 configured as six (6) separate and connected pyramid-shaped bodies 11-16, forming a single cube 30 for packaging beverages and a plethora of other liquid, powder, and solid household items within one cleverly packaged unit. It should be understood that the exemplary embodiment(s) may be used to store a variety of items, and should not be limited to any particular item described herein.

Referring to FIGS. 1-23 in general, the portable storage container 10 includes a plurality of connected pyramid-shaped bodies (collectively at 11-16) having a plurality of coextensively shaped pyramid-shaped receptacles 11*a*-11*f*, respectively. Advantageously, the pyramid-shaped bodies (collectively at 11-16) are configured to be folded into the cube 30 having a plurality of sides 30*a*-30*f* each associated with a corresponding one of the pyramid-shaped bodies (collectively at 11-16). In this manner, each of the pyramid-shaped bodies (collectively at 11-16) is contiguously situated and abutted against adjacent ones of the pyramid-shaped bodies (collectively at 11-16). Notably, each of the pyramid-shaped receptacles (collectively at 11*a*-11*f*) is isolated from adjacent ones of the pyramid-shaped receptacles (collectively at 11*a*-11*f*)—as perhaps best shown in the cross-sectional and perspective views. At least one fastener 17 is coupled to a first one of the pyramid-shaped bodies 11 and detachably mated to a second one of the pyramid-shaped bodies 12.

In a non-limiting exemplary embodiment, the pyramid-shaped bodies (collectively at 11-16) include a first pyramid-shaped body 11 having a plurality of interconnected first walls 11*g*-11*j* configured to form a first pyramid shape 11*k* wherein a first one of the pyramid-shaped receptacles 11*a* is disposed within an interior perimeter of the interconnected first walls 11*g*-11*j*, a second pyramid-shaped body 12 having a plurality of interconnected second walls 12*g*-12*j* configured to form a second pyramid shape 12*k* wherein a second one of the pyramid-shaped receptacles 11*b* is disposed within an interior perimeter of the interconnected second walls 12*g*-12*j*, a third pyramid-shaped body 13 having a plurality of interconnected third walls 13*g*-13*j* configured to form a third pyramid shape 13*k* wherein a third one of the pyramid-shaped receptacles 11*c* is disposed within an interior perimeter of the interconnected third walls 13*g*-13*j*, a fourth pyramid-shaped body 14 having a plurality of interconnected fourth walls 14*g*-14*j* configured to form a fourth pyramid shape 14*k* wherein a fourth one of the pyramid-shaped receptacles 11*d* is disposed within an interior perimeter of the interconnected fourth walls 14*g*-14*j*, a fifth pyramid-shaped body 15 having a plurality of interconnected fifth walls 15*g*-15*j* configured to form a fifth pyramid shape 15*k* wherein a fifth one of the pyramid-shaped receptacles 11*e* is disposed within an interior perimeter of the interconnected fifth walls 15*g*-15*j*, and a sixth pyramid-shaped body 16 having a plurality of interconnected sixth walls 16*g*-16*j* configured to form a sixth pyramid shape 16*k* wherein a sixth one of the pyramid-shaped receptacles 11*f* is disposed within an interior perimeter of the interconnected sixth walls 16*g*-16*j*.

In a non-limiting exemplary embodiment, the first pyramid-shaped body 11 has a first apex 11*p* centrally located inside the cube 30. Similarly, the second pyramid-shaped body 12 has a second apex 12*p* centrally located inside the cube 30. Similarly, the third pyramid-shaped body 13 has a third apex 13*p* centrally located inside the cube 30. Similarly, the fourth pyramid-shaped body 14 has a fourth apex 14*p* centrally located inside the cube 30. Similarly, the fifth pyramid-shaped body 15 has a fifth apex 15*p* centrally located inside the cube 30. Similarly, the sixth pyramid-shaped body 16 has a sixth apex 16*p* centrally located inside the cube 30.

In a non-limiting exemplary embodiment, each of the first apex 11*p*, the second apex 12*p*, the third apex 13*p*, the fourth apex 14*p*, the fifth apex 15*p*, and the sixth apex 16*p* are directly engaged with each other at a center 30*g* of the cube 30.

In a non-limiting exemplary embodiment, the first pyramid-shaped body 11 includes a first open side 11*m* opposed from the first apex 11*p* and situated at a first side 30*a* of the plurality of sides 30*a*-30*f* of the cube 30. Similarly, the second pyramid-shaped body 12 includes a second open side 12*m* opposed from the second apex 12*p* and situated at a second side 30*b* of the plurality of sides 30*a*-30*f* of the cube 30. Similarly, the third pyramid-shaped body 13 includes a third open side 13*m* opposed from the third apex 13*p* and situated at a third side 30*c* of the plurality of sides 30*a*-30*f* of the cube 30. Similarly, the fourth pyramid-shaped body 14 includes a fourth open side 14*m* opposed from the fourth apex 14*p* and situated at a fourth side 30*d* of the plurality of sides 30*a*-30*f* of the cube 30. Similarly, the fifth pyramid-shaped body 15 includes a fifth open side 15*m* opposed from the fifth apex 15*p* and situated at a fifth side 30*e* of the plurality of sides 30*a*-30*f* of the cube 30. Similarly, the sixth pyramid-shaped body 16 includes a sixth open side 16*m* opposed from the sixth apex 16*p* and situated at a sixth side 30*f* of the plurality of sides of the cube 30.

In a non-limiting exemplary embodiment, the first pyramid-shaped receptacle 11*a* begins from the first open side 11*m* and terminates at the first apex 11*p*. Similarly, the second pyramid-shaped receptacle 11*b* begins from the second open side 12*m* and terminates at the second apex 12*p*. Similarly, the third pyramid-shaped receptacle 11*c* begins from the third open side 12*m* and terminates at the third apex 13*p*. Similarly, the fourth pyramid-shaped receptacle 11*d* begins from the fourth open side 14*m* and terminates at the fourth apex 14*p*. Similarly, the fifth pyramid-shaped receptacle 11*e* begins from the fifth open side 15*m* and terminates at the fifth apex 15*p*. Similarly, the sixth pyramid-shaped receptacle 11*f* begins from the sixth open side 16*m* and terminates at the sixth apex 16*p*.

In a non-limiting exemplary embodiment, as perhaps best shown in FIGS. 3-14, a plurality of caps 35-39 are removably attached to corresponding ones of the first open side 11*m*, the second open side 12*m*, the third open side 12*m*, the fourth open side 14*m*, the fifth open side 15*m*, and the sixth open side 16*m*.

Notably, at least one of the caps 37-39 includes a bottom section 37*c*-39*c* removably attached to the cube 30 and has a first aperture 38*f*-39*f* in fluid communication with a corresponding one (or more) of the pyramid-shaped receptacles 11*a*-11*f*. A top section 37*a*-39*a* is attached to the bottom section 37*c*-39*c*.

In a non-limiting exemplary embodiment, the top section 37*a* has a continuous and uninterrupted outer surface 37*d* wherein the top section 37*a* is detachable from the bottom section 37*c*. Notably, the bottom section 37*c* further has a pull tab 37*e* affixed thereto.

In a non-limiting exemplary embodiment, the top section 38*a*-39*a* is pivotally attached to the bottom section 38*c*-39*c* wherein the top section 38*a*-39*a* has a second aperture 38*b*-39*b* in fluid communication with a first aperture 38*f*-39*f*.

The present disclosure further includes a method of utilizing a portable storage container 10 for packaging and transporting liquids, powder, and solid items. Such a method includes the steps of: providing a plurality of coextensively shaped and connected pyramid-shaped bodies (collectively at 11-16) having a plurality of pyramid-shaped receptacles (collectively at 11*a*-11*f*), respectively; folding the pyramid-shaped bodies 11-16 into a cube 30 having a plurality of sides 30*a*-30*f* each associated with a corresponding one of the pyramid-shaped bodies 11-16 such that each the pyramid-shaped bodies 11-16 is contiguously situated and abutted against adjacent ones of the pyramid-shaped bodies 11-16; isolating each the pyramid-shaped receptacles 11*a*-11*f* from adjacent ones of the pyramid-shaped receptacles 11*a*-11*f*; coupling at least one fastener 17 to a first one 11 of the pyramid-shaped bodies 11-16; and detachably mating the at least one fastener 17 to a second one 12 of the pyramid-shaped bodies 11-16.

Referring to FIGS. 1-23 in general, in a non-limiting exemplary embodiment(s), the configurable storage container 10 is a packaging apparatus that presents a multi-receptacle container 10 featuring, as the name implies, a series of six (6) pyramids 11-16 fused together to form a single cube 30. Offered in cardboard carton, plastic, glass configurations, this clever packaging concept incorporates a mathematically sound approach to ensure that the pyramids 11-16 perfectly fuse together to create the cube 30. Three-dimensional pyramid-shaped receptacles 11*a*-11*f* each contain flat walls with a cap enclosure, which could be circular, square, or a pull-up.

In a non-limiting exemplary embodiment(s), the interior of each receptacle 11*a*-11*f* may be employed to house a separate liquid or powdered product. As such, one configurable storage container 10 may contain whole milk in one receptacle 11*a*, skim milk in another receptacle 11*b*, along with half and half in a third receptacle 11*c*, powdered creamer in a fourth receptacle 11*d*, sugar in a fifth receptacle 11*e*, and sugar substitute in a sixth receptacle 11*f*, for an example of a themed configurable storage container 10 offering six related products together.

The configurable storage container 10 may be made available in a variety of sizes, from compact servings containing a total of thirty-two fluid ounces (32 fl. Oz.) of liquid to family sizes up to sixty-four ounces (64 oz.) or more. This concept also incorporates packaging a wide variety of other household staples in addition to beverages.

There are several significant benefits and advantages associated with this unique product concept. Foremost, the configurable storage container 10 offers consumers a simple and clever means of obtaining, storing and transporting multiple products, all contained within one convenient unit. Eliminating the need to purchase large, bulky cartons or bottles of separate beverages, this compact product allows users to effectively reduce clutter within household refrigerators. In addition, the practical combination of different beverages and staples in one package significantly lowers food expenditures for the household.

Satisfying the desire for variety when it comes to beverages, the configurable storage container 10 readily appeal to those who wish to enjoy something a little different from time to time. As such, one could pour a glass of orange juice during breakfast and cleanse the palate with refreshing grapefruit juice after an evening stroll, both from the same container 10. Offered in a variety of sizes and configurations, the configurable storage container 10 is ideal for virtually any household, from single people to the largest families. Although the packaging of beverages has been the primary focus of this report, this versatile concept can be easily expanded to incorporate the packaging of virtually any household staple.

The configurable storage container 10 includes such disparate items as detergent/fabric softener, mustard/ketchup, salt/pepper, shampoo/conditioner, and body wash/bath oil, just to name a few possibilities. With such unlimited potential, the opportunities for such a concept as the configurable storage container 10 are virtually endless. In addition to saving both money and space, this reusable and recyclable container 10 proves an invaluable assist in helping the environment, as landfills would experience a vast reduction in waste. Moreover, aftermarket models of empty configurable storage container 10 can be sold to consumers that allow them to fill multiple receptacles 11*a*-11*f* with any combination of products, providing easy access to almost any desired item while facilitating effortless transport and management.

The configurable storage container 10 is an innovative product that could handily revolutionize packaging for beverages and a plethora of other household items. Providing convenience, variety, and money savings, this clever product offers consumers exactly what they desire in today's hectic and fast-paced world.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A portable storage container for packaging and transporting liquids, powder, and solid items, said portable storage container comprising:

a plurality of connected pyramid-shaped bodies, each defining a respective pyramid-shaped receptacle;

wherein said pyramid-shaped bodies are configured to be folded into a cube having a plurality of sides each associated with a corresponding one of said pyramid-shaped bodies;

wherein each of said pyramid-shaped bodies is contiguously situated and abutted against adjacent ones of said pyramid-shaped bodies;

wherein each of said pyramid-shaped receptacles is isolated from adjacent ones of said pyramid-shaped receptacles; and at least one fastener coupled to a first one of said pyramid-shaped bodies and detachably mated to a second one of said pyramid-shaped bodies;

wherein said pyramid-shaped bodies comprises a first pyramid-shaped body having a plurality of interconnected first walls configured to form a first pyramid shape, a first pyramid-shaped receptacle being disposed within an interior perimeter of said interconnected first walls;

a second pyramid-shaped body having a plurality of interconnected second walls configured to form a second pyramid shape, a second pyramid-shaped receptacle being disposed within an interior perimeter of said interconnected second walls;

a third pyramid-shaped body having a plurality of interconnected third walls configured to form a third pyramid shape, a third pyramid-shaped receptacle being disposed within an interior perimeter of said interconnected third walls;

a fourth pyramid-shaped body having a plurality of interconnected fourth walls configured to form a fourth pyramid shape, a fourth pyramid-shaped receptacle being disposed within an interior perimeter of said interconnected fourth walls;

a fifth pyramid-shaped body having a plurality of interconnected fifth walls configured to form a fifth pyramid shape, a fifth pyramid-shaped receptacle being disposed within an interior perimeter of said interconnected fifth walls; and a sixth pyramid-shaped body having a plurality of interconnected sixth walls configured to form a sixth pyramid shape, a sixth pyramid-shaped receptacle being disposed within an interior perimeter of said interconnected sixth walls;

wherein each of said interconnected first walls are coextensively shaped and non-overlapping;

wherein each of said interconnected second walls are coextensively shaped and non-overlapping;

wherein each of said interconnected third walls are coextensively shaped and non-overlapping;

wherein each of said interconnected fourth walls are coextensively shaped and non-overlapping;

wherein each of said interconnected fifth walls are coextensively shaped and non-overlapping;

wherein each of said interconnected sixth walls are coextensively shaped and non-overlapping.

2. The portable storage container of claim 1, wherein said first pyramid-shaped body has a first apex centrally located inside said cube, wherein said second pyramid-shaped body has a second apex centrally located inside said cube, wherein said third pyramid-shaped body has a third apex centrally located inside said cube, wherein said fourth pyramid-shaped body has a fourth apex centrally located inside said cube, wherein said fifth pyramid-shaped body has a fifth apex centrally located inside said cube, wherein said sixth pyramid-shaped body has a sixth apex centrally located inside said cube.

3. The portable storage container of claim 2, wherein each of said first apex, said second apex, said third apex, said fourth apex, said fifth apex, and said sixth apex are directly engaged with each other at a center of said cube.

4. The portable storage container of claim 2, wherein said first pyramid-shaped body includes a first open side opposed from said first apex and situated at a first side of said plurality of sides of said cube, wherein said second pyramid-shaped body includes a second open side opposed from said second apex and situated at a second side of said plurality of sides of said cube, wherein said third pyramid-shaped body includes a third open side opposed from said third apex and situated at a third side of said plurality of sides of said cube, wherein said fourth pyramid-shaped body includes a fourth open side opposed from said fourth apex and situated at a fourth side of said plurality of sides of said cube, wherein said fifth pyramid-shaped body includes a fifth open side opposed from said fifth apex and situated at a fifth side of said plurality of sides of said cube, wherein said sixth pyramid-shaped body includes a sixth open side opposed from said sixth apex and situated at a sixth side of said plurality of sixth of said cube.

5. The portable storage container of claim 4, wherein said first pyramid-shaped receptacle begins from said first open side and terminates at said first apex, wherein said second pyramid-shaped receptacle begins from said second open side and terminates at said second apex, wherein said third pyramid-shaped receptacle begins from said third open side and terminates at said third apex, wherein said fourth pyramid-shaped receptacle begins from said fourth open side and terminates at said fourth apex, wherein said fifth pyramid-shaped receptacle begins from said fifth open side and terminates at said fifth apex, wherein said sixth pyramid-shaped receptacle begins from said sixth open side and terminates at said sixth apex.

6. The portable storage container of claim 5, further comprises: a plurality of caps removably attached to corresponding ones of said first open side, said second open side, said third open side, said fourth open side, said fifth open side, and said sixth open side;

wherein at least one of said caps includes a bottom section removably attached to said cube and having a first aperture in fluid communication with a corresponding one of said pyramid-shaped receptacles; and a top section attached to said bottom section.

7. The portable storage container of claim 6, wherein said top section has a continuous and uninterrupted outer surface, wherein said top section is detachable from said bottom section, wherein said bottom section further has a pull tab affixed thereto.

8. The portable storage container of claim 6, wherein said top section is pivotally attached to said bottom section, wherein said top section has a second aperture in fluid communication with said first aperture.

9. A portable storage container for packaging and transporting liquids, powder, and solid items, said portable storage container comprising:

a plurality of connected pyramid-shaped bodies, each defining a respective pyramid-shaped receptacle;

wherein said pyramid-shaped bodies are configured to be folded into a cube having a plurality of sides each associated with a corresponding one of said pyramid-shaped bodies;

wherein each of said pyramid-shaped bodies is contiguously situated and abutted against adjacent ones of said pyramid-shaped bodies;

wherein each of said pyramid-shaped receptacles is isolated from adjacent ones of said pyramid-shaped receptacles; and at least one fastener coupled to a first one of said pyramid-shaped bodies and detachably mated to a second one of said pyramid-shaped bodies;

wherein said pyramid-shaped bodies are coextensively shaped;

wherein said pyramid-shaped bodies comprises a first pyramid-shaped body having a plurality of interconnected first walls configured to form a first pyramid shape, a first pyramid-shaped receptacle being disposed within an interior perimeter of said interconnected first walls;

a second pyramid-shaped body having a plurality of interconnected second walls configured to form a second pyramid shape, a second pyramid-shaped receptacle being disposed within an interior perimeter of said interconnected second walls;

a third pyramid-shaped body having a plurality of interconnected third walls configured to form a third pyramid shape, a third pyramid-shaped receptacle being disposed within an interior perimeter of said interconnected third walls;

a fourth pyramid-shaped body having a plurality of interconnected fourth walls configured to form a fourth pyramid shape, a fourth pyramid-shaped receptacle being disposed within an interior perimeter of said interconnected fourth walls;

a fifth pyramid-shaped body having a plurality of interconnected fifth walls configured to form a fifth pyramid shape, a fifth pyramid-shaped receptacle being disposed within an interior perimeter of said interconnected fifth walls; and a sixth pyramid-shaped body having a plurality of interconnected sixth walls configured to form a sixth pyramid shape, a sixth pyramid-shaped receptacle being disposed within an interior perimeter of said interconnected sixth walls;

wherein each of said interconnected first walls are coextensively shaped and non-overlapping;

wherein each of said interconnected second walls are coextensively shaped and non-overlapping;

wherein each of said interconnected third walls are coextensively shaped and non-overlapping;

wherein each of said interconnected fourth walls are coextensively shaped and non-overlapping;

wherein each of said interconnected fifth walls are coextensively shaped and non-overlapping;

wherein each of said interconnected sixth walls are coextensively shaped and non-overlapping.

10. The portable storage container of claim 9, wherein said first pyramid-shaped body has a first apex centrally located inside said cube, wherein said second pyramid-shaped body has a second apex centrally located inside said cube, wherein said third pyramid-shaped body has a third apex centrally located inside said cube, wherein said fourth pyramid-shaped body has a fourth apex centrally located inside said cube, wherein said fifth pyramid-shaped body has a fifth apex centrally located inside said cube, wherein said sixth pyramid-shaped body has a sixth apex centrally located inside said cube.

11. The portable storage container of claim 10, wherein each of said first apex, said second apex, said third apex, said fourth apex, said fifth apex, and said sixth apex are directly engaged with each other at a center of said cube.

12. The portable storage container of claim 10, wherein said first pyramid-shaped body includes a first open side opposed from said first apex and situated at a first side of said plurality of sides of said cube, wherein said second pyramid-shaped body includes a second open side opposed from said second apex and situated at a second side of said plurality of sides of said cube, wherein said third pyramid-shaped body includes a third open side opposed from said third apex and situated at a third side of said plurality of sides of said cube, wherein said fourth pyramid-shaped body includes a fourth open side opposed from said fourth apex and situated at a fourth side of said plurality of sides of said cube, wherein said fifth pyramid-shaped body includes a fifth open side opposed from said fifth apex and situated at a fifth side of said plurality of sides of said cube, wherein said sixth pyramid-shaped body includes a sixth open side opposed from said sixth apex and situated at a sixth side of said plurality of sixth of said cube.

13. The portable storage container of claim 12, wherein said first pyramid-shaped receptacle begins from said first open side and terminates at said first apex, wherein said second pyramid-shaped receptacle begins from said second open side and terminates at said second apex, wherein said third pyramid-shaped receptacle begins from said third open side and terminates at said third apex, wherein said fourth pyramid-shaped receptacle begins from said fourth open side and terminates at said fourth apex, wherein said fifth pyramid-shaped receptacle begins from said fifth open side and terminates at said fifth apex, wherein said sixth pyramid-shaped receptacle begins from said sixth open side and terminates at said sixth apex.

14. The portable storage container of claim 13, further comprises: a plurality of caps removably attached to corresponding ones of said first open side, said second open side, said third open side, said fourth open side, said fifth open side, and said sixth open side;

wherein at least one of said caps includes a bottom section removably attached to said cube and having a first aperture in fluid communication with a corresponding one of said pyramid-shaped receptacles; and a top section attached to said bottom section.

15. The portable storage container of claim 14, wherein said top section has a continuous and uninterrupted outer surface, wherein said top section is detachable from said bottom section, wherein said bottom section further has a pull tab affixed thereto.

16. The portable storage container of claim 14, wherein said top section is pivotally attached to said bottom section, wherein said top section has a second aperture in fluid communication with said first aperture.

17. A method of utilizing a portable storage container for packaging and transporting liquids, powder, and solid items, said method comprising the steps of:

providing a plurality of coextensively shaped and connected pyramid-shaped bodies, each defining a respective pyramid-shaped receptacle;

folding said pyramid-shaped bodies into a cube having a plurality of sides each associated with a corresponding one of said pyramid-shaped bodies such that each of said pyramid-shaped bodies is contiguously situated and abutted against adjacent ones of said pyramid-shaped bodies;

isolating each of said pyramid-shaped receptacles from adjacent ones of said pyramid-shaped receptacles;

coupling at least one fastener to a first one of said pyramid-shaped bodies; and detachably mating said at least one fastener to a second one of said pyramid-shaped bodies;

wherein said pyramid-shaped bodies comprises a first pyramid-shaped body having a plurality of interconnected first walls configured to form a first pyramid shape, a first pyramid-shaped receptacle being disposed within an interior perimeter of said interconnected first walls;

a second pyramid-shaped body having a plurality of interconnected second walls configured to form a second pyramid shape, a second pyramid-shaped receptacle being disposed within an interior perimeter of said interconnected second walls;

a third pyramid-shaped body having a plurality of interconnected third walls configured to form a third pyramid shape, a third pyramid-shaped receptacle being disposed within an interior perimeter of said interconnected third walls;

a fourth pyramid-shaped body having a plurality of interconnected fourth walls configured to form a fourth pyramid shape, a fourth pyramid-shaped receptacle being disposed within an interior perimeter of said interconnected fourth walls;

a fifth pyramid-shaped body having a plurality of interconnected fifth walls configured to form a fifth pyramid shape, a fifth pyramid-shaped receptacle being disposed within an interior perimeter of said interconnected fifth walls; and a sixth pyramid-shaped body having a plurality of interconnected sixth walls configured to form a sixth pyramid shape, a sixth pyramid-shaped receptacle being disposed within an interior perimeter of said interconnected sixth walls;

wherein each of said interconnected first walls are coextensively shaped and non-overlapping;

wherein each of said interconnected second walls are coextensively shaped and non-overlapping;

wherein each of said interconnected third walls are coextensively shaped and non-overlapping;

wherein each of said interconnected fourth walls are coextensively shaped and non-overlapping;

wherein each of said interconnected fifth walls are coextensively shaped and non-overlapping;

wherein each of said interconnected sixth walls are coextensively shaped and non-overlapping.

* * * * *